US007589753B2

(12) United States Patent
Kitamura

(10) Patent No.: US 7,589,753 B2
(45) Date of Patent: Sep. 15, 2009

(54) PRINTER AND CONTROLLING METHOD FOR PRINTER

(75) Inventor: Gen Kitamura, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 11/565,019

(22) Filed: Nov. 30, 2006

(65) Prior Publication Data

US 2007/0081069 A1 Apr. 12, 2007

Related U.S. Application Data

(63) Continuation of application No. 10/972,273, filed on Oct. 21, 2004, now Pat. No. 7,170,540.

(30) Foreign Application Priority Data

Oct. 30, 2003 (JP) ..... 2003-370265

(51) Int. Cl.
*B41J 13/00* (2006.01)
*B41J 13/22* (2006.01)

(52) U.S. Cl. ..... 347/218

(58) Field of Classification Search ..... 347/172, 347/174, 176, 218, 105
See application file for complete search history.

(56) References Cited

U.S. PATENT DOCUMENTS

| | | | | |
|---|---|---|---|---|
| 6,069,642 | A | 5/2000 | Isobe | |
| 7,170,540 | B2 * | 1/2007 | Kitamura | 347/218 |

FOREIGN PATENT DOCUMENTS

| | | |
|---|---|---|
| JP | 61-295060 | 12/1986 |
| JP | 62-093136 | 4/1987 |
| JP | 2000-062228 | 2/2000 |
| JP | 2000-108442 | 4/2000 |
| JP | 2002-321414 | 11/2002 |
| JP | 2003-039760 | 2/2003 |

* cited by examiner

*Primary Examiner*—Huan H Tran
(74) *Attorney, Agent, or Firm*—Canon USA Inc IP Div

(57) ABSTRACT

A printer and a method of controlling the printer. The printer includes a color ink ribbon and a thermal head for forming images on recording sheets and an accommodating portion accommodating the ink ribbon and the thermal head therein. The printer includes several paths for conveying the recording sheet including a circular path around the accommodating portion. Depending on the length of the recording sheet, the printer conveys the recording sheet along one of the several paths during a printing operation.

11 Claims, 7 Drawing Sheets

PRINTER AND CONTROLLING METHOD FOR PRINTER

CROSS REFERENCE TO RELATED APPLICATIONS

This application is a continuation of U.S. patent application Ser. No. 10/972,273 filed Oct. 21, 2004, which claims priority from Japanese Patent Application No. 2003-370265 filed Oct. 30, 2003, both of which are hereby incorporated by reference herein in their entirety.

BACKGROUND OF THE INVENTION

1. Field of the Invention

The present invention relates to a printer for forming an image on a recording medium such as a recording sheet based on image data, and also relates to a method for controlling the printer.

2. Description of the Related Art

Printers are classified according to the method of image creation, such as thermal transfer printers, ink jet printers, laser printers, and wire dot printers. Thermal transfer printers perform dot line printing on a recording sheet with an ink ribbon. This type of printer has a plurality of heaters arranged in the main scanning direction. The heaters are selectively heated while the ink ribbon and the recording sheet are conveyed in the sub-scanning direction. Recently, with advances in image input devices such as digital cameras, digital camcorders, and image scanners, thermal transfer printers have received a lot of attention. Thermal transfer printers are suitable for outputting electronic image data obtained with a digital still camera or a digital camcorder via a personal computer or a data storage medium.

Other printers, such as ink jet printers, have only two (binary) options, forming a dot or not forming a dot. Therefore, resolution and gradation are achieved typically by the error diffusion technique using small dots. On the other hand, the thermal transfer printer is capable of pixel-by-pixel shading by varying the amount of heat. Therefore, the thermal transfer printer achieves smoother and higher quality images in comparison with other printer types such as ink jet printers. In addition, due to improvements in thermal heads and materials used for the recording sheets, the thermal transfer printer has achieved image printing quality comparable to a silver salt photograph. In step with the advances in digital cameras, thermal transfer printers are now attracting interest, especially as printers for natural images.

A system capable of printing by using a data storage medium without connecting a thermal transfer printer and an imaging device, such as a digital camera and a digital camcorder, has been developed. In addition, a system capable of printing without using a personal computer but by connecting a thermal transfer printer and the imaging device has also been developed. These systems make it easy to print out image data from a digital camera or a digital camcorder. Therefore, increasing attention is being paid to thermal transfer printers.

FIG. 10 is a schematic view showing a printing mechanism of a conventional compact thermal transfer printer. Pressed between a platen roller 107 and a thermal head 109, a recording sheet P and an ink ribbon 110 come into contact with each other. Ink on the ink ribbon 110 is transferred onto the recording sheet P by heat generated by the thermal head 109. The recording sheet P is conveyed by a pair of rollers 105A and 105B disposed forward of the thermal head 109 in the conveying direction. Printing is thus performed.

In order to recreate desired colors, it is necessary to repeat printing in a plurality of colored inks, such as yellow, magenta, and cyan. Therefore, printing takes a long time in comparison with other printers. In addition, after printing in the first color is completed, in order to perform printing in the next color, it is necessary to release the recording sheet P from the pressure of the thermal head 109, to rotate the rollers 105A and 105B in reverse, and to return the recording sheet P to the starting position. This makes the printing time much longer.

To solve this problem, a printer is disclosed in Japanese Patent Laid-Open No. 2003-39760. In this printer, the printing time is reduced by reducing the time to return the recording sheet. The circumference of a platen roller is longer than a recording sheet. The recording sheet is conveyed along the circumference of the platen roller. The recording sheet is pressed against the platen roller by a pushing member. With rotation of the platen roller, the recording sheet is conveyed due to friction with the platen roller in the rotating direction of the platen roller.

When printing in the first color is completed, the leading edge of the recording sheet is short of the thermal head. Rotating the platen roller slightly further returns the recording sheet to the starting position. Printing in the next color is thus performed smoothly. Since this printer requires very little time to return the recording sheet in comparison with the conventional thermal transfer printer, the printing time is reduced.

However, this printer requires increasing the size of the platen roller according to the size of the recording sheet. Therefore, the size of the printer body is also increased. In addition, in the case where a wide variety of recording sheets are to be used and there is a great difference in length between the largest size and the smallest size, the platen roller tailored for the largest size of recording sheet cannot quickly return the smaller sizes of recording sheets.

SUMMARY OF THE INVENTION

The present invention is directed to a printer, and a method for controlling the printer, capable of reduced printing time without increasing the size of the printer body, and without limiting the size of the recording sheet.

In one aspect of the present invention, a printer for printing an image on a recording sheet includes a sheet feeder housing recording sheets; a sheet outlet receiving the recording sheet with the printed image; an ink cassette including an ink ribbon and a thermal head operable to heat the ink ribbon so as to transfer ink from the ink ribbon onto the recording sheet; an accommodating portion accommodating the ink cassette therein; and a conveyance path of the recording sheet between the sheet feeder and the sheet outlet, the conveyance path including a circular path provided around the accommodating portion. Images are printed by heating the color ink ribbon with the thermal head and transferring the ink onto the recording sheet.

As described above, in the printer according to the present invention, the conveyance path of the recording sheet includes the circular path around the accommodating portion for the ink cassette. When printing in the first color is completed, the leading edge of the recording sheet is short of the thermal head. Therefore, printing in the next color can be started immediately. Printing time is thus reduced. In addition, since the recording sheet is circulated around the accommodating portion for the ink cassette, space is saved. The size of the printer is thus prevented from increasing.

In one embodiment of the present invention, the printer includes a first roller pair and a second roller pair operable to convey the recording sheet in the conveyance path, the first roller pair being disposed between the sheet feeder and the thermal head, and the second roller pair being disposed between the thermal head and a sheet outlet. In another embodiment, the conveyance path includes an ejecting path diverging from the circular path and provided between the second roller pair and the sheet outlet. A switch provided at the junction of the circular path and the ejecting path is operable to switch the conveyance route of the recording sheet between the circular path and the ejecting path.

In another embodiment, the conveyance path includes a reciprocation path meeting the circular path between the sheet feeder and the first roller pair. The printer according to the present invention may further include a detecting unit for detecting the length of the recording sheet in the conveying direction.

In another aspect of the present invention, a method for controlling the printer described above includes the steps of detecting a length of the recording sheet; responsive to detecting the length of the recording sheet being a first length, conveying the recording sheet to the thermal head along a circular path provided around the accommodating portion and printing an image on the recording sheet with the color ink ribbon and the thermal head as the recording sheet is being conveyed along the circular path; and conveying the recording sheet with the printed image to the sheet outlet. The controlling method for the printer according to the present invention repeats a plurality of printing processes in different colors.

In one embodiment, the method includes responsive to detecting the length of the recording sheet being a second length, conveying the recording sheet along a second path between a reciprocation path meeting the circular path between the sheet feeder and the first roller pair, and an ejecting path diverging from the circular path between the second roller pair and the sheet outlet; and printing an image on the recording sheet with the color ink ribbon and the thermal head as the recording sheet is being conveyed along the second path.

In another embodiment, the method includes responsive to detecting the length of the recording sheet being a third length, conveying the recording sheet along a third path between the reciprocation path and the second roller pair; and printing an image on the recording sheet with the color ink ribbon and the thermal head as the recording sheet is being conveyed along the third path.

In some embodiments, the third path includes the ejecting path.

As described above, in the case of the recording sheet that is too long or too short to circulate in the circular path, printing can be performed by using other conveyance routes. Therefore, the printer according to the present invention can handle a plurality of sizes of recording sheets.

Further features and advantages of the present invention will become apparent from the following description of the embodiment (with reference to the attached drawings).

DESCRIPTION OF THE EMBODIMENT

Figure 1:
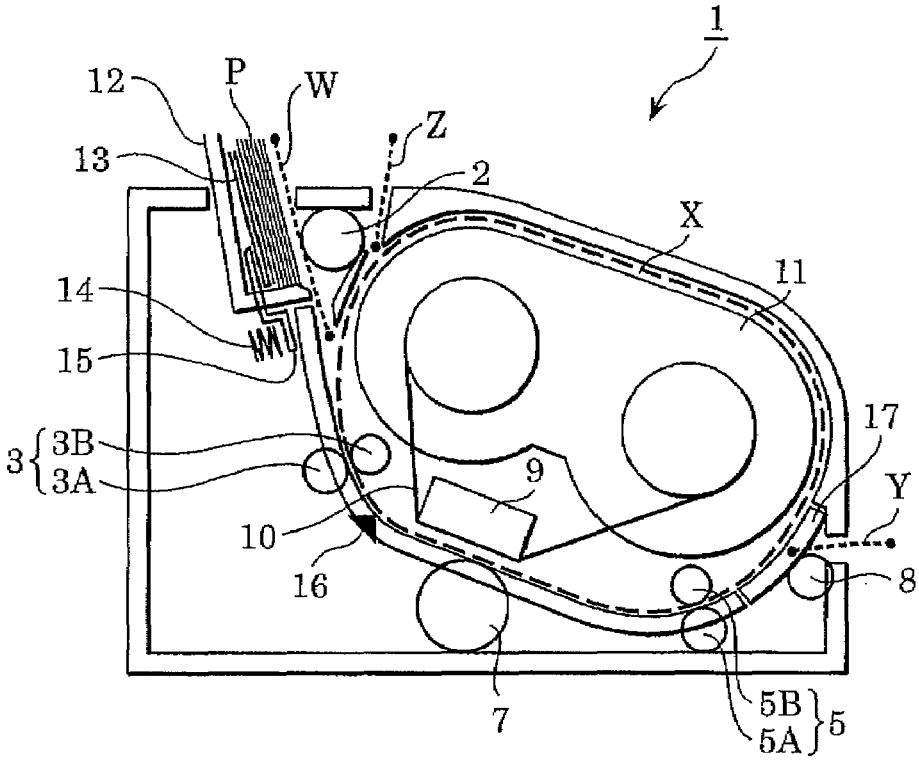
FIG. 1 is a schematic vertical cross-sectional view showing the overall structure of a printer of the present invention.

An embodiment of the present invention will now be described with reference to the drawings. FIG. 1 is a schematic vertical cross-sectional view showing the overall structure of a printer according to this embodiment.

Inside a printer body 1, an ink cassette 11 is accommodated in an accommodating portion. The ink cassette 11 contains an ink ribbon 10. Around the ink cassette 11, an oval circular path X is provided. At the ink-transferring portion, a thermal head 9 is provided inside the circular path X. Opposite the thermal head 9, a platen roller 7 is provided. Pressed between the platen roller 7 and the thermal head 9, the recording sheet P and the ink ribbon 10 come into contact with each other. The recording sheet P and the ink ribbon 10 are thus conveyed together. Heaters on the thermal head 9 are selectively heated, thus transferring ink applied to the ink ribbon 10 onto the recording sheet P. The ink cassette 11 can be inserted into or pulled out of the side wall of the printer body 1 in the direction perpendicular to the paper.

In the circular path X and between a sheet cassette 12 and the thermal head 9, a first roller pair 3 is provided. The first roller pair 3 consists of a grip roller 3A and a pinch roller 3B. A feeding path W and a reciprocation path z are continuous with the circular path X. The feeding path W is straight and is for feeding a recording sheet P. The reciprocation path Z is also straight, and the recording sheet P reciprocates back and forth in the path Z. In the feeding path W, a feeding roller 2 is provided. Between the platen roller 7 and the first roller pair 3, a sheet sensor 16 is provided. The sheet sensor 16 detects that the recording sheet P passes the sensor 16.

The sheet cassette 12 provided in the feeding path W accommodates the recording sheets P. Before printing, the sheet cassette 12 is inserted in the printer body 1. The recording sheets P come in a plurality of sizes: a credit-card size, an L-size, a postcard (four-by-six) size, and a four-by-eight size. A plurality of sizes of sheet cassettes 12 are used according to the sizes of the recording sheet P. On the bottom of the sheet cassette 12, a pushing plate 13 is hinged. When the sheet cassette 12 is inserted in the printer body 1, the pushing plate 13 is pressed against the feeding roller 2 by a spring 14 via a pushing member 15. Therefore, the recording sheets P in the sheet cassette 12 are pressed against the feeding roller 2 by the pushing plate 13.

An ejecting path Y branches off from the circular path X. The ejecting path Y is straight and is for ejecting the recording sheet P. In the circular path X and between the thermal head 9 and the ejecting path, a second roller pair 5 is provided. The second roller pair 5 consists of a grip roller 5A and a pinch roller 5B. In the ejecting path Y, an ejecting roller 8 is provided. Next to the ejecting roller 8, a conveyance guide 17 is provided. The conveyance guide 17 switches the conveyance route to the ejecting path Y.

Each roller described above is supported by the two side walls of the printer body 1. Each roller is connected to a motor (not shown) via gears. Powered by the motor, the rollers convey the recording sheet P.

Figure 2:
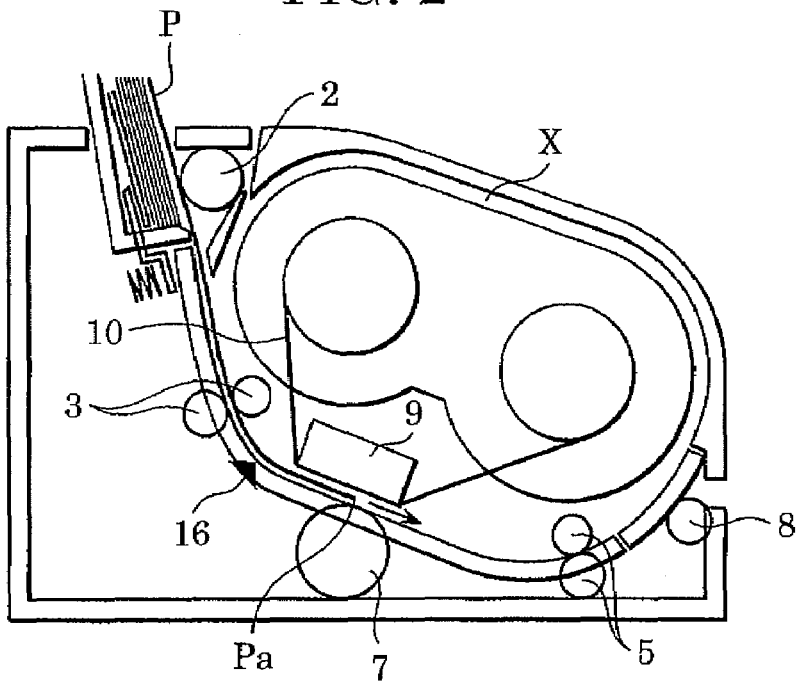
FIG. 2 is an explanatory view showing a postcard-size recording sheet at the starting position of printing.

Next, the flow of printing will be described. First, the case where the recording sheet P is a postcard size will be described. FIG. 2 shows the recording sheet P conveyed to the thermal head 9.

The feeding roller 2 rotates to feed the recording sheet P sheet-by-sheet. The recording sheet P is thus conveyed by the feeding roller 2. The leading edge Pa of the recording sheet P goes into the circular path X, and is caught by the first roller pair 3. The holding power of the first roller pair 3 is sufficiently strong in comparison with those of the feeding roller 2 and the ejecting roller 8. The conveyance of the recording sheet P is controlled accurately by the first roller pair 3. The recording sheet P is further conveyed by the first roller pair 3, and the sheet sensor 16 detects the leading edge Pa of the recording sheet P. Then, the recording sheet P is further conveyed for a predetermined distance, and the leading edge Pa arrives at the position just before the position between the platen roller 7 and the thermal head 9. This position is the starting position.

When the printing operation starts, the thermal head 9 is pressed against the platen roller 7. The recording sheet P is thereby conveyed together with the ink ribbon 10, and thermal transfer of ink is performed. The platen roller 7 is rotated by the motor (not shown) in the forward direction at the same circumferential speed as the first roller pair 3 so that the contact between the thermal head 9 and the platen roller 7 does not prevent conveyance of the recording sheet P.

The recording sheet P is further conveyed and also caught by the second roller pair 5. The circumferential speed of the second roller pair 5 is also the same as the first roller pair 3. Neither compression nor tension acts on the recording sheet P. Conveyance is thus performed smoothly. Then, the trailing edge Pb is released from the first roller pair 3. The recording sheet P is conveyed by the second roller pair 5 alone.

Figure 3:
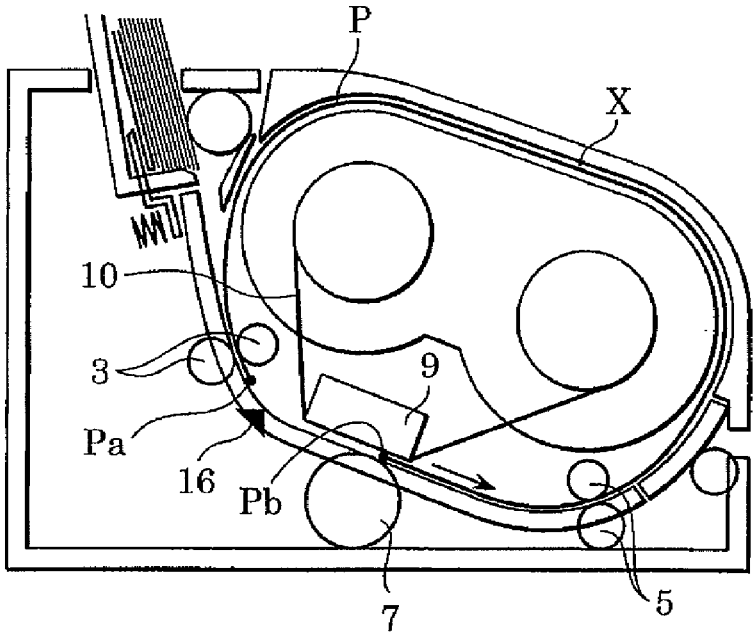
FIG. 3 is an explanatory view showing a postcard-size recording sheet at the ending position of printing.

When the trailing edge Pb passes the heating portion of the thermal head 9, printing in the first color is completed. FIG. 3 shows the recording sheet P just about to pass the heating portion of the thermal head 9.

The recording sheet P is further conveyed by the second roller pair 5 along the circular path X, and the leading edge Pa is again caught by the first roller pair 3.

When the printing in the first color is completed, the thermal head 9 comes out of contact with the platen roller 7. The ink ribbon 10 is wound up to position the thermal head 9 at the first part of the next color portion on the ink ribbon, as in cueing of a video tape. On the other hand, the recording sheet P is conveyed further. After the sheet sensor 16 detects the leading edge Pa, the recording sheet P is conveyed further for a predetermined distance. Then, the above-described printing operation is repeated. The printing in the next color is thus performed.

Figure 4:
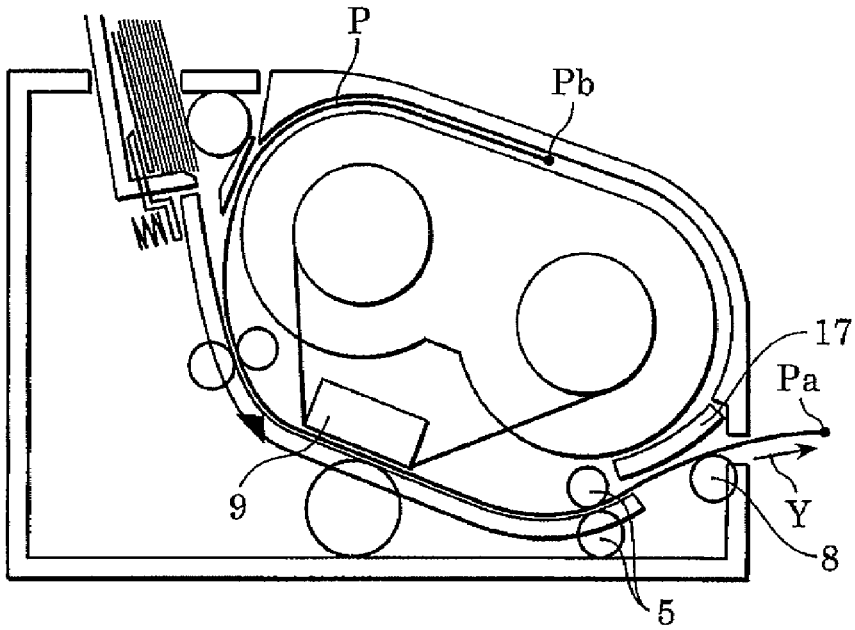
FIG. 4 is an explanatory view showing the conveyance route when the postcard-size recording sheet is printed in the last color.

FIG. 4 shows the printing in the last color. After the printing in the last color, the recording sheet P is conveyed not in the circular path X but into the ejecting path Y and is then ejected. Specifically, the conveyance guide 17 forming part of the circular path X moves upward, thereby forming part of the ejecting path Y. The recording sheet P is conveyed along the ejecting path Y, and goes over the rotating ejecting roller 8. After the trailing edge Pb passes the heating portion of the thermal head 9 and the printing is completed, conveying is performed by the second roller pair 5. After the recording sheet P is released from the second roller pair 5, conveying is performed by the ejecting roller 8. The recording sheet P is thus ejected from the printer body 1.

Figure 5:
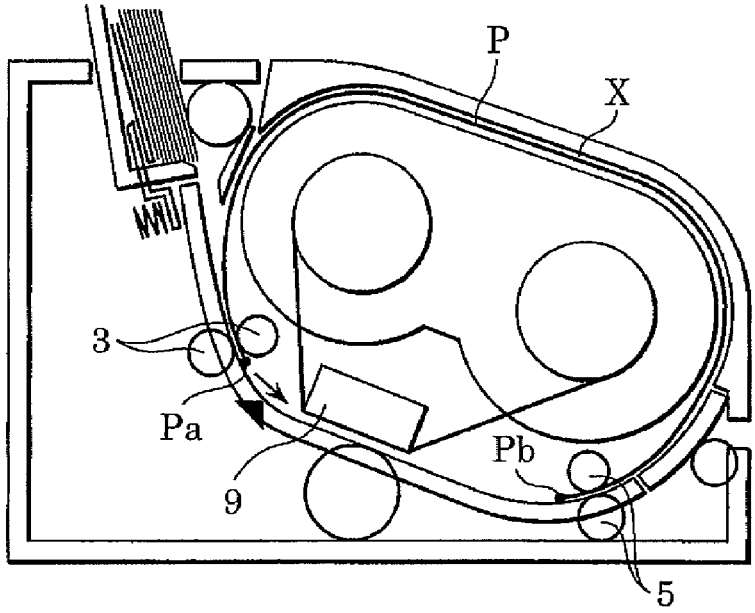
FIG. 5 is an explanatory view of the conveyance route for an L-size recording sheet.

Next, the case of an L-size recording sheet will be described. The L-size recording sheet is about 30 mm shorter than the postcard-size recording sheet. The flow of printing is the same as in the case of the postcard size. The process from sheet feeding to printing is the same as in the case of the postcard size. FIG. 5 shows the recording sheet P going away from the heating portion of the thermal head 9, the trailing edge Pb being short of the second roller pair 5. The circular path X is divided into two sections by the first roller pair 3 and the second roller pair 5. In this embodiment, the first roller pair 3 and the second roller pair 5 are disposed so that both sections are shorter than the L-size recording sheet. That is to say, in FIG. 5, the recording sheet P is held by both the first roller pair 3 and the second roller pair 5. When the recording sheet P moves clockwise, it is held by the second roller pair 5 alone. When the recording sheet P moves counter-clockwise, it is held by the first roller pair 3 alone.

As described above, in the case of the postcard-size or L-size recording sheet, when the recording sheet P is conveyed in the circular path X, the recording sheet P is held by at least one of the first roller pair 3 and the second roller pair 5. By the cyclic conveyance using the circular path X, a reduction in the printing time is achieved. Since the conveyance paths are around the ink cassette, the printer body is prevented from growing in size in comparison with the conventional printers.

Next, the case of a four-by-eight-size recording sheet will be described. The four-by-eight-size recording sheet is about 50 mm longer than the postcard-size recording sheet. The overall length of the circular path X is set 30 mm longer than the postcard-size recording sheet. Therefore, the length of the four-by-eight-size recording sheet exceeds the overall length of the circular path X by 20 mm. The circular path X cannot be used for circulating the four-by-eight-size recording sheet. In the case of the four-by-eight-size recording sheet, a different conveyance route from that for the postcard-size and L-size recording sheets is used, and reciprocating conveyance is performed as in the conventional thermal transfer printer.

Figure 6:
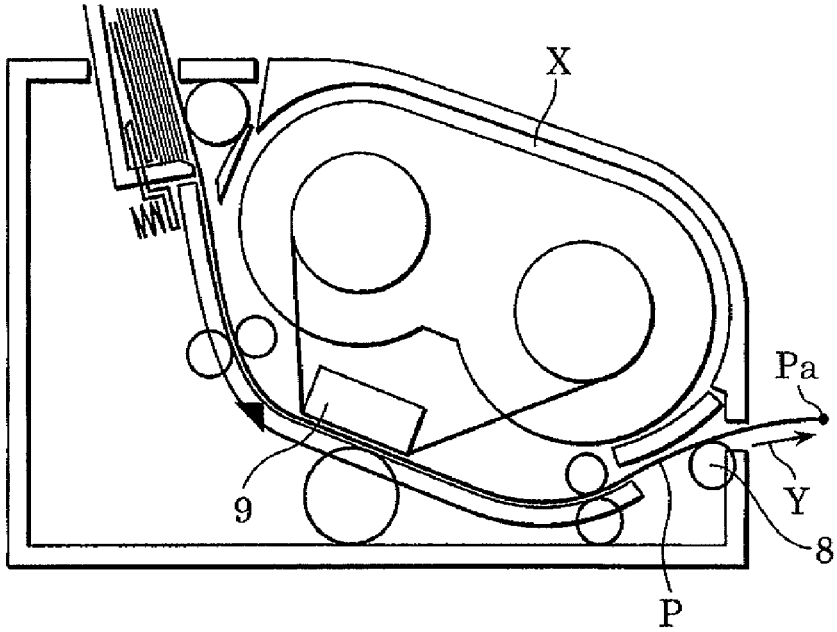
FIG. 6 is an explanatory view of the conveyance route for a four-by-eight-size recording sheet.
Figure 7:
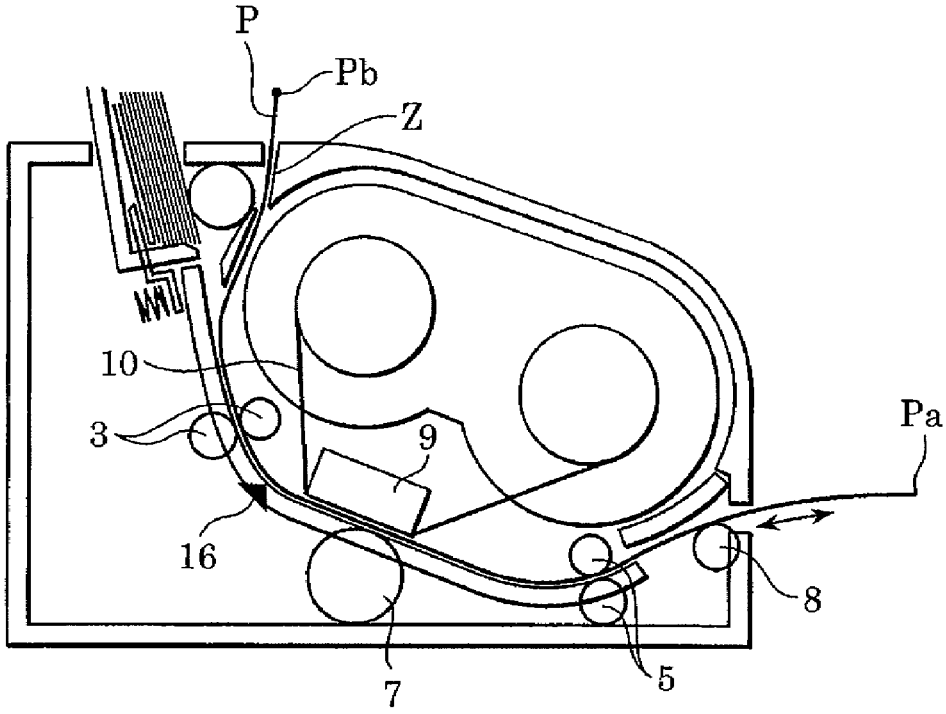
FIG. 7 is an explanatory view of the conveyance route for the four-by-eight-size recording sheet.

Specifically, after the four-by-eight-size recording sheet P is conveyed to the starting position, the conveyance route is switched from the circular path X to the ejecting path Y. As shown in FIG. 6, the leading edge Pa of the recording sheet P enters the ejecting path Y. The leading edge Pa of the recording sheet P goes over the ejecting roller 8 and projects from the printer body 1. The trailing edge Pb of the recording sheet P passes the heating portion of the thermal head 9, and the printing in the first color is completed. Then, as shown in FIG. 7, the thermal head 9 comes out of contact with the platen roller 7, and the first roller pair 3, the second roller pair 5, the platen roller 7, and the ejecting roller 8 rotate in reverse to return the recording sheet P to the starting position. The recording sheet P is thus conveyed backward. The trailing edge Pb of the recording sheet P passes through the first roller pair 3, goes in reverse in the circular path X, enters the reciprocation path Z, and projects from the printer body 1. Reverse conveyance is further performed. The leading edge Pa of the recording sheet P passes between the platen roller 7 and the thermal head 9, and passes the sheet sensor 16. When the sensor 16 has stopped detecting the recording sheet P, the reverse conveyance is stopped. Then, the thermal head 9 is positioned at the first part of the next color portion on the ink ribbon 10, and the recording sheet P is conveyed forward again. After the sensor 16 detects the recording sheet P, the recording sheet P is further conveyed for a predetermined distance and arrives at the starting position.

The printing in the next color is then performed. The above-described operation is repeated up to the last color. When the printing in the last color is completed, the recording sheet P is conveyed forward and ejected through the ejecting path Y.

Figure 8:
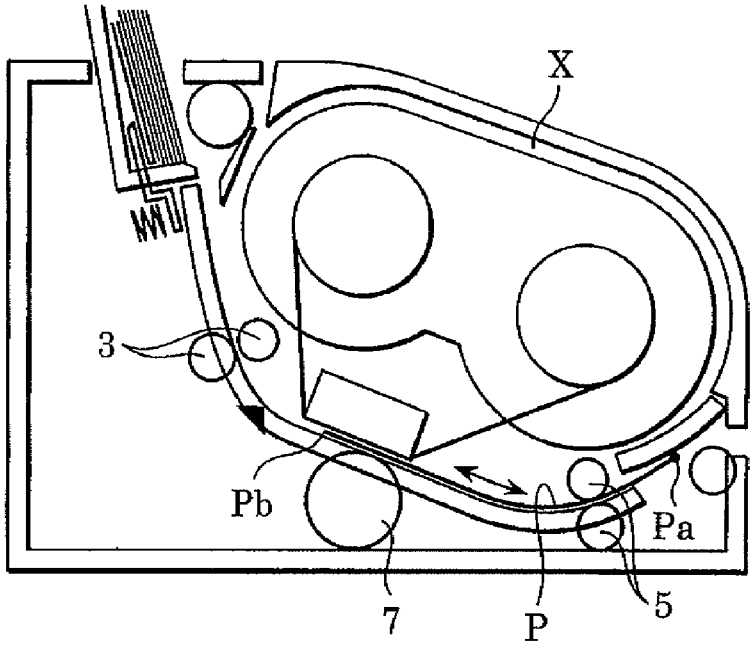
FIG. 8 is an explanatory view of the conveyance route for a credit-card-size recording sheet.

Next, the case of a credit-card-size recording sheet will be described. The credit-card-size recording sheet is about 50 mm shorter than the L-size recording sheet. If the credit-card-size recording sheet is conveyed in the circular path X, it becomes held by neither the first roller pair 3 nor the second roller pair 5. Therefore, the credit-card-size recording sheet cannot be circulated in the circular path X. Therefore, in the case of the credit-card-size recording sheet, the above-described reciprocating conveyance is also performed as in the case of the four-by-eight-size recording sheet. FIG. 8 shows the case of the credit-card-size recording sheet. The distance from the first roller pair 3 to the second roller pair 5 via the platen roller 7 is determined to be shorter than the credit-card-size recording sheet. Therefore, the recording sheet P is held and conveyed by at least one of the first roller pair 3 and the second roller pair 5. Although the ejecting path Y is used in FIG. 8, the circular path X may be used, except for ejecting.

As described above, in the case of a recording sheet that is too long or too short to circulate in the circular path X, printing can be performed by using other conveyance routes. Therefore, this printer can handle a plurality of sizes of recording sheets.

Figure 11:
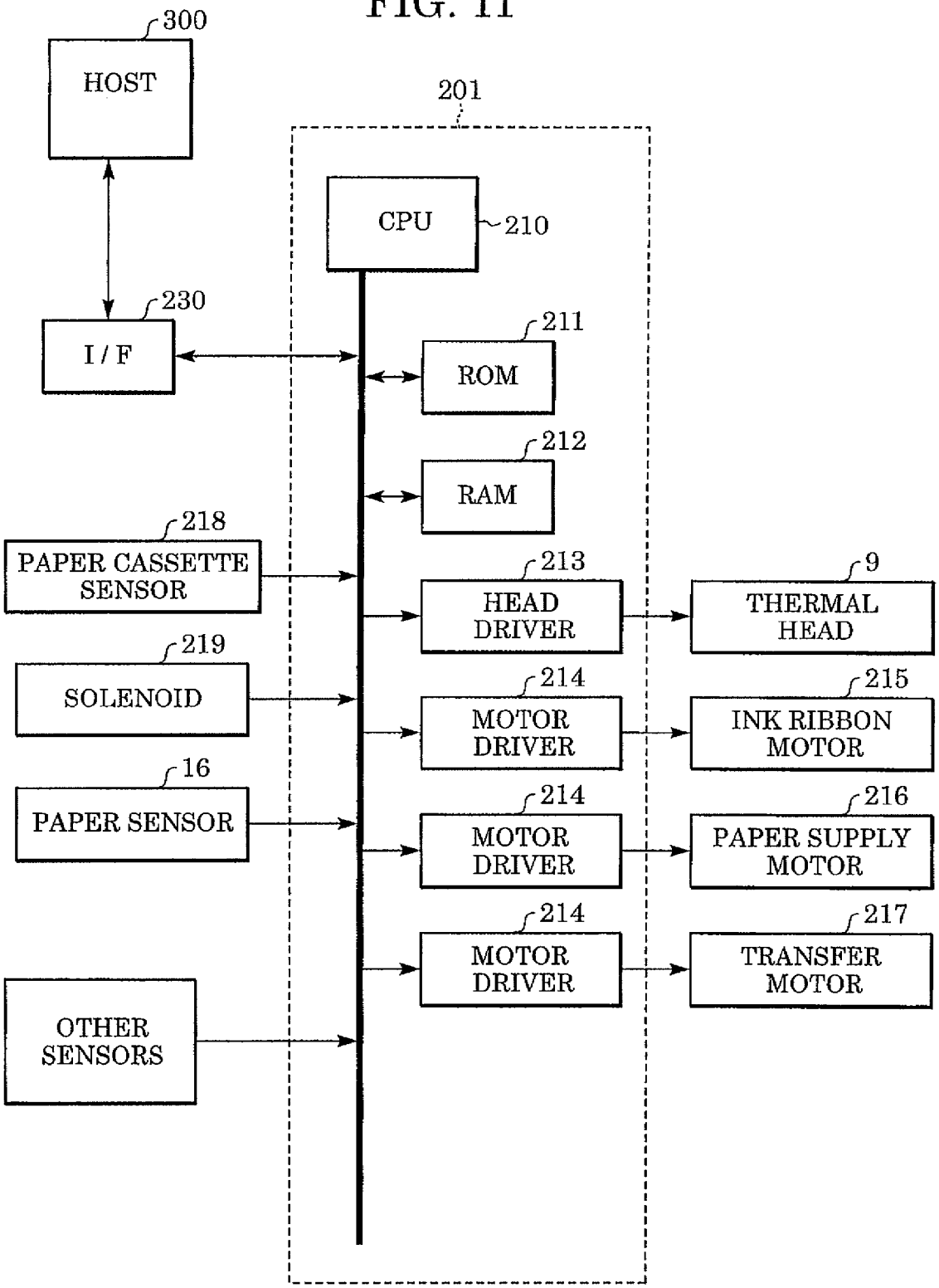
FIG. 11 is a block diagram of a control system of the present invention.

FIG. 11 is a block diagram of a control system of the printer. A control plate 201 of the control system includes a CPU 210 for controlling various components of the printer and outputting control instructions to each component, a read-only memory (ROM) 211 for storing control data, and a random-access memory (RAM) having a work area for recording data. A head driver 213 drives the thermal head 9. An ink ribbon motor 215 is operable to wind the ink ribbon 10. A sheet supply motor 216 drives the roller 2. A transfer motor 217 drives the roller pair 3, the roller pair 5, the platen roller 7, and the roller 8. A plurality of motor drivers 214 are provided to drive each of the motors 215, 216 and 217. A sensor 218 detects the size of the sheet cassette inserted into a sheet cassette slot of the printer body 1. A solenoid 219 switches the conveyance guide 17 between the path Y and the circular path X. An interface 230 allows for communicating data with a host 300 like a digital camera.

Figure 9:
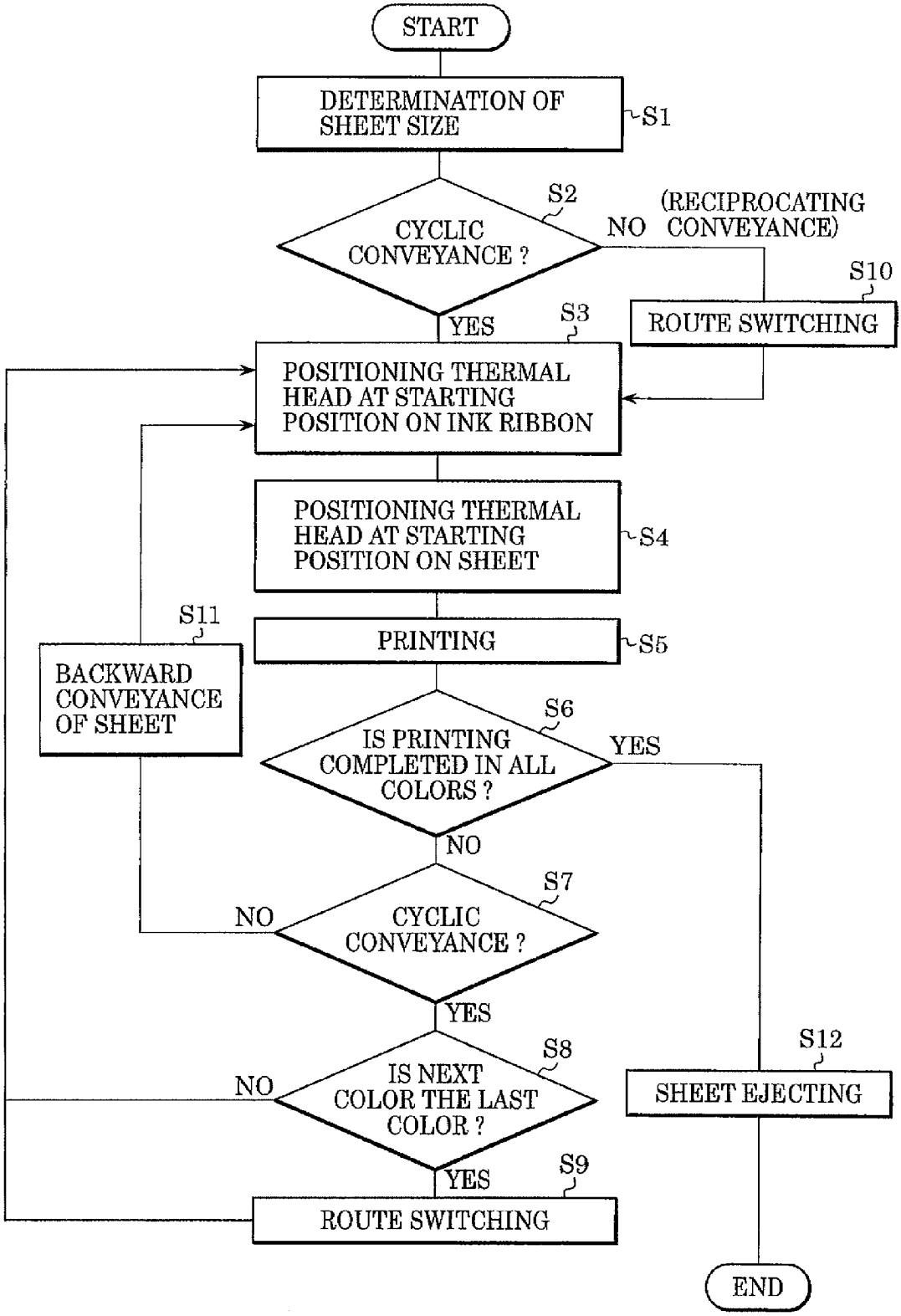
FIG. 9 is a flow chart showing a sequence of printing operations.
Figure 10:
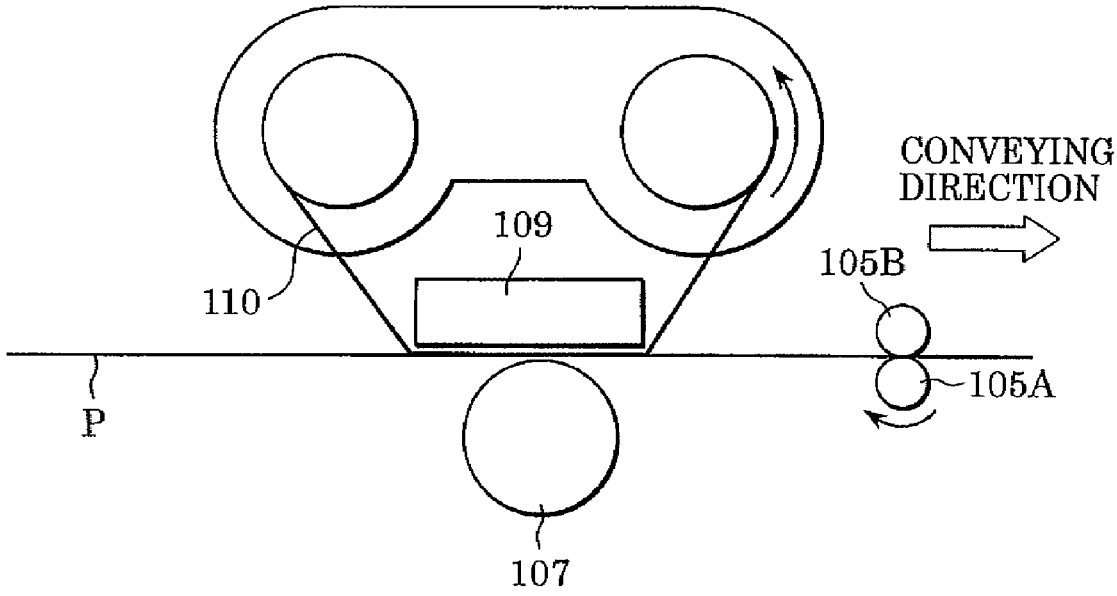
FIG. 10 PRIOR ART
FIG. 10 is an explanatory view of the mechanism of a conventional thermal transfer printer.

Next, the sequence of printing operations will be described. FIG. 9 is a flow chart showing the sequence of printing operations of the printer according to this embodiment.

First, in Step SI, the CPU 210 determines the size of the recording sheet P. A plurality of sheet cassettes 12 having different sizes and shapes are prepared according to the sizes of the recording sheet P. The sheet cassette sensor 218 is provided in the sheet cassette slot of the printer body 1. The sheet cassette sensor detects the shape of the inserted sheet cassette and determines the size of the recording sheet P. Based on the detected size by the sensor 218, the CPU 210 controls the process to Step S3 or S10. In Step S2, if the recording sheet P is the postcard size or the L-size, the flow moves to Step S3, and the recording sheet P is printed by cyclic conveyance. If the recording sheet is the four-by-eight size or the credit-card size, the flow moves to Step S10, and the recording sheet P is printed by reciprocating conveyance.

In the case of reciprocating conveyance, the conveyance route is switched to the ejecting path Y by the conveyance guide 17 (Step S10). The CPU 210 controls the conveyance guide 17 to switch to the ejecting path Y via the solenoid 219.

In Step S3, the ink ribbon 10 is wound up to position the thermal head 9 at the first part of the first color portion on the ink ribbon, as in cueing of a video tape. The CPU 210 controls the ink ribbon motor 215 to wind the ink ribbon 10.

In Step S4, the CPU 210 causes the motor 216 to rotate the feeding roller 2 to feed the recording sheet P to the printer body 1. The CPU 210 drives the transfer motor 217. After the leading edge Pa of the recording sheet P is detected by the sheet sensor 16, the CPU 210 causes the recording sheet P to be conveyed further for a predetermined distance to arrive at the starting position.

In Step S5, the CPU 210 causes the thermal head 9 to be pressed against the platen roller 7. The recording sheet P is conveyed together with the ink ribbon 10. The CPU 210 controls the printing operation such that the heaters on the thermal head 9 are selectively heated and printing is performed. After forming a predetermined number of dot lines according to the size of the recording sheet P, the CPU 210 causes the thermal head 9 to come out of contact with the platen roller 7.

After Step S5 is completed, whether the printing in the last color is completed or not is determined by the CPU 210 in Step S6. If not, the CPU 210 controls start of printing in the next color. If the printing is performed by cyclic conveyance (Step S7) and the next color is not the last color (Step S8), the CPU controls the flow to return to Step S3. If the next color is the last color, the CPU 210 causes the conveyance route to switch to the ejecting path Y by the conveyance guide 17 in Step S9, and then the flow returns to Step S3. On the other hand, if the printing is performed by reciprocating conveyance, the CPU 210 causes the conveyance rollers to rotate in reverse to convey the recording sheet P backward in Step S11. When the sheet sensor 16 detects the leading edge Pa of the recording sheet P passing the sensor 16, the CPU causes backward conveyance of the recording sheet P to stop, and then the flow returns to Step S3.

After Step S5 is completed, if the CPU 210 determines that the printing is completed in all colors in Step S6, the CPU 210 causes the recording sheet P to be ejected from the printer body 1 in Step S12.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A printer conveying a recording sheet and printing an image on the recording sheet with a recording device, the printer comprising:

a circular path facilitating circulating the recording sheet, wherein the recording sheet is conveyed around the circular path so that the recording device repeats printing on the recording sheet in different colors;

a sheet feeder configured to feed the recording sheet;

a sheet outlet;

first and second roller pairs provided on the circular path and configured to convey the recording sheet, the first roller pair being disposed between the sheet feeder and the recording device, and the second roller pair being disposed between the recording device and the sheet outlet;

an ejecting path diverging from the circular path and provided between the second roller pair and the sheet outlet; and a switch provided at the junction of the circular path and the ejecting path and configured to switch a conveyance route of the recording sheet between the circular path and the ejecting path.

2. The printer according to claim 1, further comprising a reciprocation path meeting the circular path between the sheet feeder and the first roller pair.

3. The printer according to claim 2, further comprising a detecting unit configured to detect the length of the recording sheet in the conveying direction.

4. The control method of the printer according to claim 3, the control method comprising:

determining the length of the recording sheet with the detecting unit; and selecting the control method according to claim 6 based on the determination result.

5. The control method of the printer according to claim 3, the control method comprising:

determining the length of the recording sheet with the detecting unit; and selecting the control method according to claim 8 based on the determination result.

6. The control method of the printer according to claim 3, the control method comprising:

determining the length of the recording sheet with the detecting unit; and selecting the control method according to claim 10 based on the determination result.

7. A control method of the printer according to claim 1 for repeating a plurality of printing processes in different colors, the control method comprising:

conveying the recording sheet beyond the recording device;

conveying the recording sheet to the recording device again along the circular path when the length of the recording sheet is shorter than the entire circumference of the circular path and longer than both a first section from the second roller pair to the first roller pair and a second section from the first roller pair to the second roller pair, and when at least one process remains to be done;

switching the conveyance route with the switch to the ejecting path when no process remains to be done; and ejecting the recording sheet through the ejecting path.

8. The control method according to claim 7, further comprising:

conveying the recording sheet backward via the recording device when the length of the recording sheet is shorter than the first section and longer than the second section, and at least one process remains to be done;

conveying the recording sheet forward to the recording device again;

switching the conveyance route with the switch to the ejecting path when no process remains to be done; and ejecting the recording sheet through the ejecting path.

9. A control method of the printer according to claim 2 for repeating a plurality of printing processes in different colors, the control method comprising:

conveying the recording sheet beyond the recording device;

conveying the recording sheet to the recording device again along the circular path when the length of the recording sheet is shorter than the entire circumference of the circular path and longer than both a first section from the second roller pair to the first roller pair and a second section from the first roller pair to the second roller pair, and when at least one process remains to be done;

switching the conveyance route with the switch to the ejecting path when no process remains to be done; and ejecting the recording sheet through the ejecting path.

10. The control method according to claim 9, further comprising:

conveying the recording sheet backward via the recording device when the length of the recording sheet is shorter than the first section and longer than the second section, and at least one process remains to be done;

conveying the recording sheet forward to the recording device again;

switching the conveyance route with the switch to the ejecting path when no process remains to be done; and ejecting the recording sheet through the ejecting path.

11. A control method of the printer according to claim 2 for repeating a plurality of printing processes in different colors, the control method comprising:

switching the conveyance route with the switch to the ejecting path when the length of the recording sheet is longer than the entire circumference of the circular path;

conveying the recording sheet into the ejecting path via the recording device;

conveying the recording sheet backward into the reciprocation path via the recording device when at least one process remains to be done;

conveying the recording sheet to the recording device again; and ejecting the recording sheet through the ejecting path when no process remains to be done.

* * * * *